US009115318B2

(12) United States Patent
Al-Abdulal et al.

(10) Patent No.: US 9,115,318 B2
(45) Date of Patent: Aug. 25, 2015

(54) HYDROCRACKING PROCESS WITH INTEGRAL INTERMEDIATE HYDROGEN SEPARATION AND PURIFICATION

(71) Applicant: Saudi Arabian Oil Company, Dhahran (SA)

(72) Inventors: Ali Hasan Al-Abdulal, Dhahran (SA); Yuv Raj Mehra, Dhahran (SA); Vinod Ramaseshan, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 17 days.

(21) Appl. No.: 13/667,694

(22) Filed: Nov. 2, 2012

(65) Prior Publication Data

US 2013/0112595 A1 May 9, 2013

Related U.S. Application Data

(60) Provisional application No. 61/555,797, filed on Nov. 4, 2011.

(51) Int. Cl.

| | |
|---|---|
| ***C10G 65/12*** | (2006.01) |
| ***C10G 49/22*** | (2006.01) |
| ***C10G 49/00*** | (2006.01) |

(52) U.S. Cl.

CPC ..... *C10G 65/12* (2013.01); *C10G 49/007* (2013.01); *C10G 2300/202* (2013.01); *C10G 2300/301* (2013.01); *C10G 2300/4006* (2013.01); *C10G 2300/4012* (2013.01); *C10G 2300/42* (2013.01)

(58) Field of Classification Search

CPC ..... C10G 2300/202; C10G 2300/301; C10G 2300/4006; C10G 2300/4012; C10G 2300/42; C10G 49/007; C10G 65/12

USPC ..... 208/49, 57, 89, 108, 209

See application file for complete search history.

(56) References Cited

U.S. PATENT DOCUMENTS

| | | | |
|---|---|---|---|
| 3,256,178 | A | 6/1966 | Hass et al. |
| 3,328,290 | A | 6/1967 | Hengstebeck |
| 3,540,999 | A | 11/1970 | Jacobs |
| 3,779,897 | A | 12/1973 | Wrench et al. |
| 4,197,184 | A | 4/1980 | Munro et al. |

(Continued)

FOREIGN PATENT DOCUMENTS

| | | | |
|---|---|---|---|
| GB | 970357 | A | 9/1964 |
| WO | 9523835 | A1 | 9/1995 |

OTHER PUBLICATIONS

PCT/US2012/063270, International Search Report and Written Opinion dated Feb. 14, 2013, 11 pages.

*Primary Examiner* — Walter D Griffin
*Assistant Examiner* — Derek Mueller
(74) *Attorney, Agent, or Firm* — Abelman, Frayne & Schwab

(57) ABSTRACT

An intermediate hydrogen separation and absorption-based purification system is integrated with a hydrocracking process for the production of relatively lower molecular weight products from a relatively heavy feedstock including sulfur-containing and nitrogen-containing hydrocarbon compounds. The integrated process allows the processing of heavy hydrocarbon feedstock having high nitrogen and high sulfur contents in a single-stage configuration and the using of noble metal catalyst in the hydrocracking reaction zone. The integrated process increases the overall catalytic activity and hydrogenation capability to produce superior distillate products.

13 Claims, 3 Drawing Sheets

(56) References Cited

U.S. PATENT DOCUMENTS

| | | | |
|---|---|---|---|
| 4,212,726 | A | 7/1980 | Mayes |
| 4,517,074 | A | 5/1985 | Ward |
| 4,740,222 | A | 4/1988 | Mehra |
| 4,832,718 | A | 5/1989 | Mehra |
| 4,940,530 | A | 7/1990 | Kukes et al. |
| 4,954,241 | A | 9/1990 | Kukes et al. |
| 5,114,562 | A | 5/1992 | Haun et al. |
| 5,312,543 | A | 5/1994 | Taylor et al. |
| 5,382,349 | A | 1/1995 | Yoshita et al. |
| 5,403,469 | A | 4/1995 | Vauk et al. |
| 5,462,583 | A | 10/1995 | Wood et al. |
| 5,546,764 | A | 8/1996 | Mehra |
| 5,551,972 | A | 9/1996 | Wood et al. |
| 5,968,346 | A | 10/1999 | Jung et al. |
| 6,096,190 | A | 8/2000 | Cash |
| 6,113,775 | A | 9/2000 | Christolini et al. |
| 6,153,086 | A | 11/2000 | Gupta et al. |
| 6,179,995 | B1 | 1/2001 | Cash et al. |
| 6,294,079 | B1 | 9/2001 | Thakkar et al. |
| 6,635,170 | B2 | 10/2003 | Ravella |
| 6,638,418 | B1 | 10/2003 | Kalnes et al. |
| 6,740,226 | B2 | 5/2004 | Mehra et al. |
| 6,797,154 | B2 | 9/2004 | Mukherjee et al. |
| 7,238,274 | B2 | 7/2007 | Turner |
| 7,238,275 | B2 | 7/2007 | Stupin et al. |
| 7,238,277 | B2 | 7/2007 | Dahlberg et al. |
| 7,259,288 | B2 | 8/2007 | Khan |
| 7,531,082 | B2 | 5/2009 | Mukherjee et al. |
| 7,547,386 | B1 | 6/2009 | Thakkar et al. |
| 7,686,941 | B2 | 3/2010 | Brierley et al. |
| 7,763,218 | B2 | 7/2010 | Hunter et al. |
| 2003/0111386 | A1 | 6/2003 | Mukherjee et al. |
| 2003/0132138 | A1 | 7/2003 | Mehra et al. |
| 2007/0017851 | A1 | 1/2007 | Mehra et al. |

HYDROCRACKING PROCESS WITH INTEGRAL INTERMEDIATE HYDROGEN SEPARATION AND PURIFICATION

RELATED APPLICATIONS

This application claims the benefit of U.S. Provisional Patent Application No. 61/555,797 filed Nov. 4, 2011, the disclosure of which is hereby incorporated by reference.

BACKGROUND OF THE INVENTION

1. Field of the Invention

The present invention relates to hydrocracking systems and method for efficient reduction of sulfur and nitrogen content of hydrocarbons.

2. Description of Related Art

Hydrocracking processes are used commercially in petroleum refineries typically to process a variety of feedstocks. In general, hydrocracking processes split the larger molecules of the feedstock into smaller, i.e., lighter, molecules having higher average volatility and economic value. Additionally, hydrocracking processes typically improve the quality of the hydrocarbon feedstock by increasing the hydrogen to carbon ratio and by removing organosulfur and organonitrogen compounds. The significant economic benefit derived from hydrocracking processes has resulted in substantial development of process improvements and more active catalysts.

Mild hydrocracking or single-stage once-through hydrocracking occurs at operating conditions that are more severe than those required in hydrotreating processes, and less severe than those required for conventional full pressure hydrocracking processes. Mild or single-stage hydrocracking operations are typically more cost effective, but conventionally produce a reduced yield of mid-distillate products, and of a relatively lower quality, as compared to conventional full pressure or multiple stage hydrocracking processes. Single or multiple catalysts systems can be used depending upon the feedstock processed and product specifications. Single-stage hydrocracking is the simplest of the various configurations, and is typically designed to maximize mid-distillate yield over a single or dual catalyst systems. Dual catalyst systems can be deployed as a stacked-bed configuration or in multiple reactors.

In a series-flow configuration the entire hydrocracked product stream from the first reaction zone, including light gases (e.g., $C_1$ to $C_4$, $H_2S$, $NH_3$) and all remaining hydrocarbons, is sent to the second reaction zone. In two-stage configurations the feedstock is refined by passing it over a hydrotreating catalyst bed in the first reaction zone. The effluents from the first reaction zone are passed to a fractionating zone to separate the light gases, naphtha and diesel products boiling in the temperature range of 36° C. to 370° C. The hydrocarbons boiling above 370° C. are then passed to the second reaction zone for additional cracking. The configurations are decided based on the processing objectives and the types of feedstock. As feedstock becomes heavier for particular processing objectives, the configurations become more complicated.

Heaviness of the hydrocarbon feedstock implies higher feedstock distillation end point (lower American Petroleum Institute (API) gravity) and higher levels of coke precursors. As the boiling point range of the hydrocarbon feedstock increases, the nitrogen and sulfur heteroatom content also increases. Consequently, the catalyst system encounters high levels of ammonia and hydrogen sulfide while processing such a feedstock. The basic ammonia can neutralize the acidity on the catalyst and thus reduces the overall catalyst activity. Hence, to achieve a target conversion rate, the amount of catalyst required is higher for relatively heavier hydrocarbon feedstocks. Furthermore, the presence of hydrogen sulfide has a negative effect on the overall quantity and quality of the distillate intermediate and final products. Thus, when processing relatively heavy hydrocarbon feedstocks, conventional hydrocracking configurations require higher catalyst volumes, higher pressure and/or multiple stages.

A traditional two-stage hydrocracking system 1000 flow scheme is shown in FIG. 2. Hydrotreating reaction zone 100 includes a reactor 144 containing an effective quantity of a suitable hydrotreating catalyst. Reactor 144 includes an inlet for receiving a combined stream 130 including a feedstock stream 120 and a hydrogen stream 124 and an inlet for receiving a quenching hydrogen stream 146. A hydrotreated effluent stream 140 is discharged from an outlet of reactor 144. In certain embodiments a hydrogen gas inlet stream 124 can be separate from the feed inlet stream 120 as opposed to combining with the feed prior to entering reactor 144 as stream 130 (in addition to the inlet for introducing quenching gas). In the traditional flow scheme that is conventionally used for processing high nitrogen and high sulfur feeds, the hydrotreating zone effluent stream 140 is combined with a hydrogen stream 180 and directly routed as stream 330 to a first hydrocracking zone 300 which includes a hydrocracking reactor 320 that may have single or multiple catalyst beds and receive quench hydrogen stream in between the beds as shown by stream 326.

The first hydrocracking zone 300 is consequently in a sour environment (high ammonia and hydrogen sulfide). Thus, to limit the amount of catalyst required, the degree of conversion in the first hydrocracking zone 300 is limited. The first hydrocracking zone effluent stream 340 passes to separation zone 500 including two separators 510 and 520. The liquid effluent streams 518 and 560 then enters the flash zone 600 (including separators 630 and 640) to produce streams 638, 644, 648 and 650 as shown in the FIG. 2. The hydrocarbon liquid side stream 648 is combined with the bottom liquid stream 638 to form feed stream 690 which enters the fractionation zone 700. The fractionation zone 700 produces the variety of products which includes an overhead stream 710, a first side-stream 720, a second side-stream 730, and a bottom stream 735. Typically, stream 710 comprises naphtha, the first side-stream 720 comprises kerosene and the second side-stream 730 comprises diesel. At least a portion of the bottom stream 735 flows as stream 740 to the second hydrocracking zone 800 and a portion of stream 750 is purged out of the system.

The stream 740 is mixed with recycle hydrogen stream 745 and enters the second hydrocracking zone 800. The second hydrocracking zone 800 includes a hydrocracking reactor 820 which may have single or multiple catalyst beds and receive quench hydrogen stream in between the beds as shown by stream 826. The effluent from the second hydrocracking zone 840 then joins the effluent stream 340 from the first hydrocracking zone 300 and passes to separation zone 500.

A cold high-pressure drum 520 provides an overhead stream 514, which is rich in hydrogen and hydrogen sulfide and is then routed to an amine scrubbing system to remove the hydrogen sulfide. The sweet gas stream 570 which is rich in hydrogen can be recycled back after compression through recycle hydrogen compressor 580 to produce stream 585 that is recycled back to the hydrogen manifold "Header A". The high purity make-up hydrogen stream 204 from manifold "Header B" is either from a hydrogen plant or from a pressure swing adsorption unit or a reforming unit.

Notwithstanding the state of the art, it would be desirable to provide more efficient hydrocracking processes and systems.

SUMMARY OF THE INVENTION

The above objects and further advantages are provided by herein described process. An intermediate hydrogen separation and absorption-based purification system is integrated with a hydrocracking process for the production of relatively lower molecular weight products from a relatively heavy feedstock including sulfur-containing and nitrogen-containing hydrocarbon compounds. The integrated process allows the processing of heavy hydrocarbon feedstock having high nitrogen and high sulfur contents in a single-stage configuration and the using of noble metal catalyst in the hydrocracking reaction zone. The integrated process increases the overall catalytic activity and hydrogenation capability to produce superior distillate products.

The integrated hydrocracking process comprises:

a. hydrotreating a feedstock with a hydrotreating catalyst in the presence of hydrogen to produce a hydrotreated effluent containing a reduced amount of sulfur-containing and/or nitrogen-containing hydro carbon compounds as compared to the feedstock;

b. separating the hydrotreated effluent in a high-pressure separation zone to produce a vapor stream and a hydrocarbon liquid stream;

c. purifying at least a portion of the vapor stream in an absorption zone in the presence of at least a portion of relatively heavy components of the vapor stream from step (b) to produce a high purity hydrogen gas stream and a fuel gas stream;

d. hydrocracking at least a portion of the hydrocarbon liquid stream from step (b) with a hydrocracking catalyst in the presence of hydrogen gas to produce a hydrocracked effluent, wherein the hydrogen gas includes at least a portion of the high purity hydrogen gas stream from step (c); and e. separating and fractionating the hydrocracked effluent to produce hydro cracked gas product and one or more hydrocracked liquid fractions.

In certain embodiments, step (b) comprises separating the hydrotreated effluent in a hot high-pressure separation zone to produce a hydrotreated gas stream and a hydrotreated liquid stream, and separating the hydrotreated gas stream in a cold high-pressure separation zone to produce a vapor stream, a hydrocarbon liquid stream and a sour water stream, wherein the relatively heavier components of the vapor stream used in step (c) are derived from the further condensation of the heavier fractions in the vapor stream generated from the cold separator and additional make up provided by the portion of the hydrocarbon liquid stream from the cold high-pressure separation zone.

BRIEF DESCRIPTION OF THE DRAWINGS

The following detailed description will be best understood when read in conjunction with the attached drawings. For the purpose of illustrating the invention, the drawings show embodiments which are presently preferred. It should be understood, however, that the invention is not limited to the precise arrangements and apparatus shown. In the drawings the same numeral is used to refer to the same or similar elements, in which.

DETAILED DESCRIPTION OF THE INVENTION

An integrated hydrocracking configuration is provided which incorporates hydrogen separating zone along with hydrogen purification by absorption. These additional steps are located between the hydrotreating reaction zone and the hydrocracking reaction zone in a single-stage hydrocracking system. This removes ammonia and hydrogen sulfide from the intermediate reaction effluent, and allows a purified hydrogen stream to be recombined with the liquid streams to be hydrocracked in an essentially ammonia-free and hydrogen sulfide-free environment.

Figure 1:
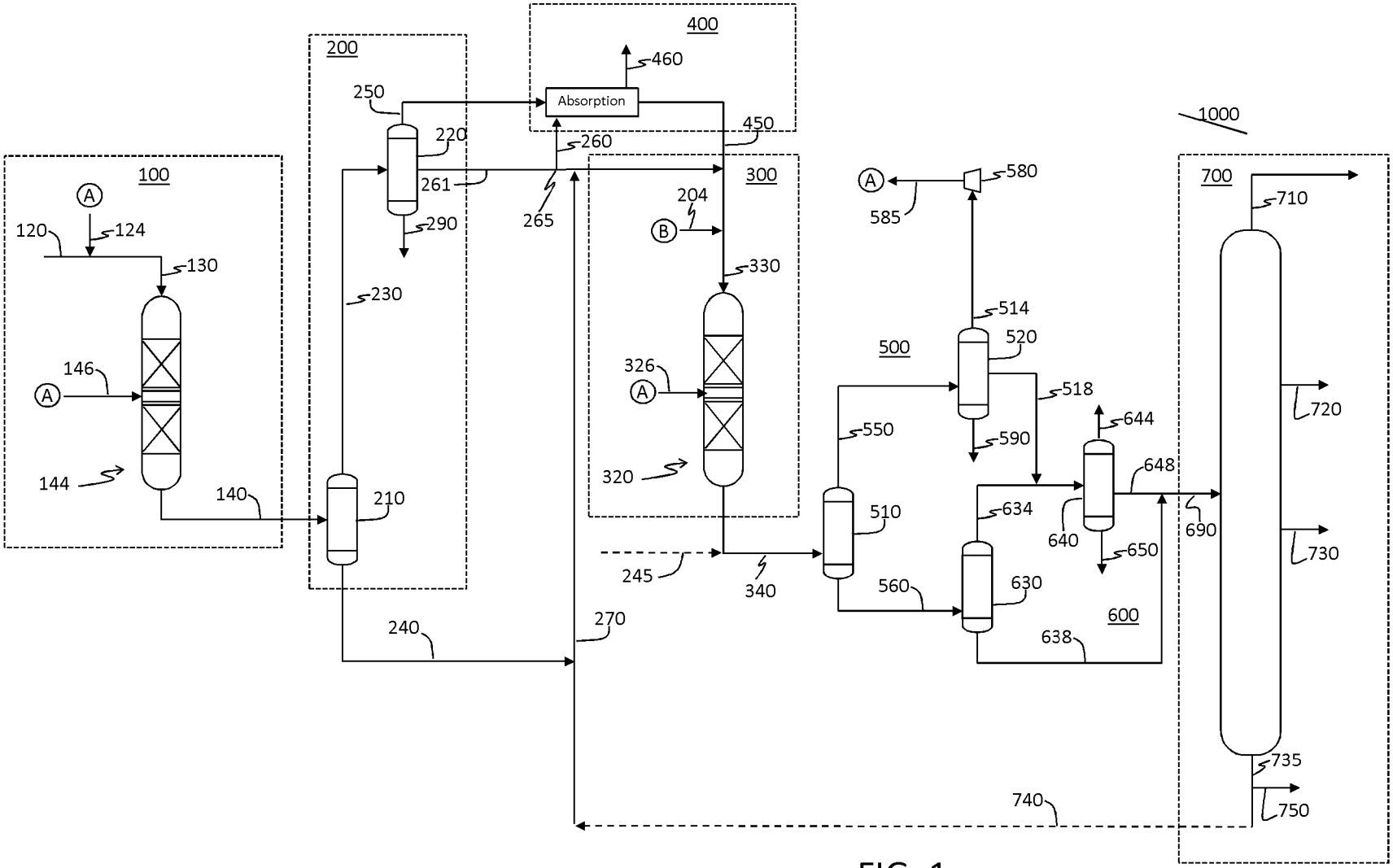
FIG. 1 is a flow diagram of a single-stage hydrocracking system with recycle of unconverted oil integrated with an intermediate hydrogen separation and purification system.
Figure 2:
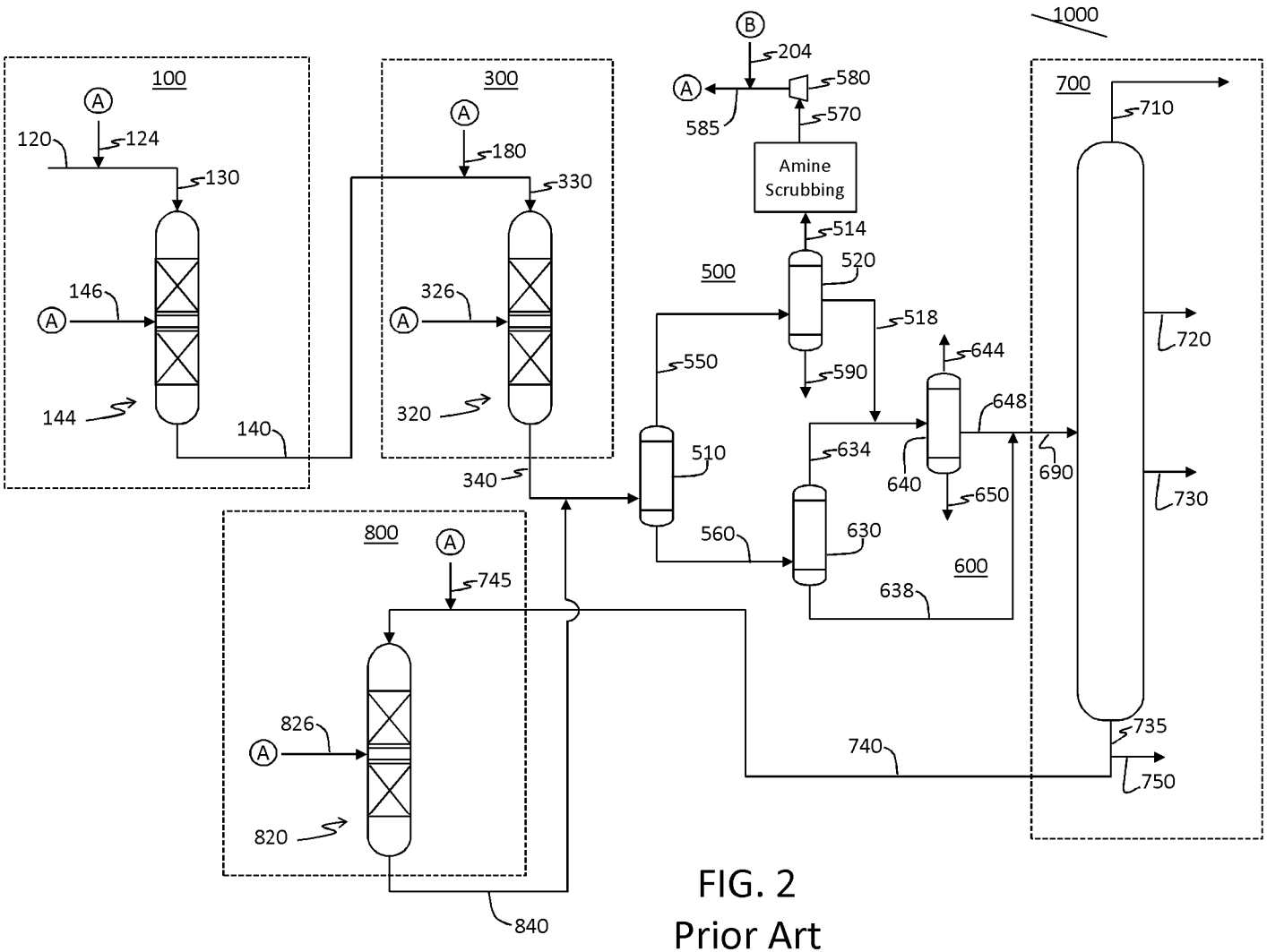
FIG. 2 Prior Art
FIG. 2 is a flow diagram of a conventional hydrocracking system operating in a two-stage configuration.

In particular, and referring now to FIG. 1, a flow diagram of an integrated hydrocracking system 1000 operating in a single-stage configuration with recycle of unconverted oil is illustrated. System 1000 includes a hydrotreating zone 100, a first high-pressure separation zone 200, hydrocracking zone 300, an absorption zone for enriching hydrogen gas 400, a second high pressure separation zone 500, a flash zone 600, and a fractionation zone 700.

Hydrotreating reaction zone 100 includes a reactor 144 containing an effective quantity of a suitable hydrotreating catalyst. Reactor 144 includes an inlet for receiving a combined stream 130 including a feedstock stream 120 and a hydrogen stream 124 and an inlet for receiving a quenching hydrogen stream 146. A hydrotreated effluent stream 140 is discharged from an outlet of reactor 144. In certain embodiments a hydrogen gas inlet can be separate from the feed inlet (in addition to the inlet for introduction of quenching hydrogen).

The first high-pressure separation zone 200 generally includes a hot high-pressure separation vessel 210 and a cold high-pressure separation vessel 220. Hot high-pressure separation vessel 210 includes an inlet for receiving the hydrotreated effluent 140, an outlet for discharging a hydrotreated gas stream 230, and an outlet for discharging a hydrotreated liquid stream 240. Cold high-pressure separation vessel 220 includes an inlet in fluid communication with and for receiving the partially condensed the hydrotreated gas stream 230, an outlet for discharging a sour water stream 290, an outlet for discharging a vapor stream 250 and an outlet for discharging a liquid hydrocarbon stream 261. Heat exchangers required to cool the hot stream before entering subsequent cold high pressure separator are not shown and their requirement should be understood by all skilled in the art. Stream 230 includes one or more gases selected from the group comprising hydrogen, methane, ethane, ammonia, hydrogen sulfide, $C_5$+ hydrocarbons, exits the first separation vessel 210.

Figure 3:
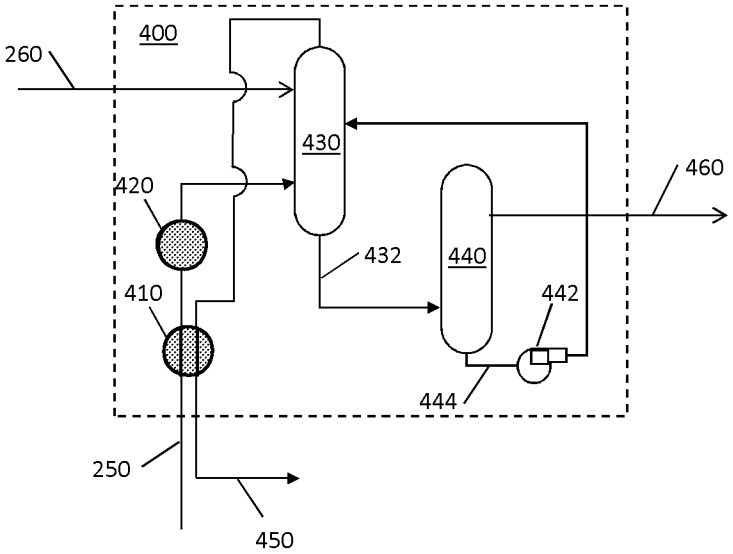
FIG. 3 is a schematic diagram of an absorption zone.

As shown in FIG. 3 absorption zone 400 includes a cross exchanger 410, a chiller 420, a methane absorber column 430, a flash regeneration vessel 440 and a solvent circulation pump 442. Methane absorber column 430 includes an inlet for receiving vapor stream 250 from high-pressure separation zone 200 after cross-exchanger 410 and chiller 420, an inlet for receiving recycle solvent stream 444 from flash regeneration vessel 440, an inlet for receiving solvent make-up stream 260, an outlet for discharging a rich solvent liquid stream 432 and an outlet for discharging a hydrogen stream 450.

In absorption zone 400, stream 250 leaves the cold high pressure separator 220, which is a relatively low $H_2$ purity stream, is counter-currently contacted with a portion of condensed hydrocarbon liquids from stream 260 as solvent in the methane absorber column 430 to absorb the methane and heavier hydrocarbons away from the contained hydrogen.

Stream 250 is chilled in a heat exchanger 410 by cross-exchanging with a colder, purified, recycled hydrogen stream 450, followed by refrigeration unit 420 where it is cooled to about −20° F. In the absorber column 430, most heavy gases including methane, ethane, propane, butanes and pentanes, are absorbed away from the contained hydrogen in stream 250. The rich solvent liquid stream 432 from the bottom of absorption zone 430 is passed to at least one flashing stage 440. Through pressure let down in flash drums, the rich solvent liquid stream 432 is separated into a sour fuel gas stream 460 containing adsorbed $C_1$+ hydrocarbon components and a lean liquid solvent stream 444 that can be recycled back to the methane absorber column 430 using a solvent circulation pump 442. The bulk of the solvent used for absorption is primarily the heavier hydrocarbons which are condensed from stream 250 after chilling. The hydrocarbon stream 260 is used primarily as a makeup solvent.

Arrangements similar to absorption zone 400 are shown in U.S. Pat. Nos. 6,740,226, 4,740,222, 4,832,718, 5,462,583, 5,546,764 and 5,551, 972, and U.S. Pub. No. 2007/0017851, the disclosures of which are all incorporated by reference herein in their entireties.

As depicted, process flow lines in the figures can be referred to as streams, feeds, products, or effluents. Depending upon the ammonia content, a water stream (not shown) can be added to stream 230 to remove ammonium bisulfide salts. The stream 290, which is predominantly sour water, can then be sent to any suitable destination such as a sour water stripper. The separated vapor from separator 220 leaves through stream 250 and enter the absorption zone 400. Separated hydrocarbons from separator 220 can be partly routed to form the absorption solvent as stream 260 for the absorption zone 400. The liquid stream 240 from separator 210 can be combined with heavy liquid recycle stream 740 from the fractionation unit 700 and the excess hydrocarbon stream 265 from the separator 220 to form a combined stream 270 to enter hydrocracking zone 300.

The absorption zone 400 purifies the hydrogen present in stream 250 by absorbing components heavier than hydrogen with circulating solvent comprising solvent make-up stream 260 to produce a high purity (95-99 mol %) hydrogen stream 450 and a fuel gas stream 460 comprising components heavier than hydrogen as present in stream 250.

The high purity hydrogen stream 450 along with high purity make-up hydrogen stream 204 from manifold "Header B" then combine with liquid stream 270 to form a combined feed 330 to enter the hydrocracking zone 300.

The hydrocracking zone 300 includes a hydrocracking reactor 320, which may have single or multiple catalyst beds and receive quench hydrogen streams in between the beds as simply shown by stream 326. Although only one quench hydrogen stream is shown, it should be understood that multiple streams may be provided to the hydrocracking reactor 320 depending upon the number of beds. The hydrocracking zone 300 can operate at any suitable condition. The effluent stream 340 from the hydrocracking zone 300 passes to second separation zone 500.

Separation zone 500 includes a hot separation vessel 510 and a cold separation vessel 520. The hot separation vessel 510 separates stream 340 into a gas stream 550 comprising hydrogen and methane, and a liquid stream 560. Stream 550 then enters the cold separator vessel 520, while the stream 560 enters the flash zone 600. The flash zone 600 includes a hot low-pressure flash drum 630 and a cold low-pressure flash drum 640. Heat exchangers required to cool the hot streams before entering subsequent separators and flash drums are not shown and their requirement should be understood by all skilled in the art. Typically, the cold separator drum 520 and flash drums 630 and 640 serve to separate gases from condensed liquids or from liquids through pressure let down.

Particularly, the high-pressure cold separator drum 520 can provide an overhead stream 514 comprising hydrogen and methane but is predominantly rich in hydrogen, a hydrocarbon side stream 518 and a bottom stream 590 which is predominantly sour water that can be sent to any suitable destination such as a sour water stripper. A water stream (not shown) may be added to stream 550 to remove ammonium salts. Similarly, the hot low-pressure flash drum 630 can provide overhead stream 634 comprising hydrogen and methane and a bottom liquid stream 638. The overhead stream 634 after cooling in a heat exchanger (not shown) and the hydrocarbon side stream 518 enter the low pressure cold flash drum 640. The flash drum 640 separates an overhead stream 644 comprising residual hydrogen and methane that may be sent to any suitable destination, such as a flare or fuel gas recovery or hydrogen recovery; doing so may require additional compression. The bottom stream 650 which is predominantly sour water can be sent to any suitable destination, such as sour water stripping. The hydrocarbon liquid side stream 648 is combined with the bottom liquid stream 638 to form feed stream 690 which enters the fractionation zone 700.

Generally, the fractionation zone 700 produces a variety of products, and includes an overhead stream 710, a first side-stream 720, a second side-stream 730, and a bottom stream 735. Typically, stream 710 comprises naphtha, the first side-stream 720 comprises kerosene and the second side-stream 730 comprises diesel. Typically, the kerosene stream 720 meets a product specification, such as a smoke point, while the diesel stream 730 meets its product specification, such as a maximum sulfur content and minimum cetane number requirements. At least a portion of the bottom stream 735 may be recycled back to the hydrocracking zone 300 as stream 740 and small amount, stream 750 purged out of the system.

The cold high-pressure separator drum 520 provides an overhead stream 514, which is rich in hydrogen and can be recycled back after compression through recycle hydrogen compressor 580 to produce stream 585 which is recycled back to the hydrogen manifold "Header A." The high purity make-up hydrogen stream 204 from manifold "Header B" can be from a hydrogen plant, a pressure swing adsorption unit, a reforming unit or other suitable source.

In an alternate embodiment the flow scheme of FIG. 1, a portion of the stream 240 bypasses the hydrocracking zone as stream 245 (shown in dashed lines) and joins the effluent stream 340 from the hydrocracking zone 300 and is passed to a second separation zone 500. The bottom stream 735 from the fractionation zone 700 is also withdrawn as a product for further processing as a feedstock to a fluid catalytic cracking unit or as a blending stock for heavy fuels. In this embodiment, no part of bottom stream 735 from fractionation zone 700 is recycled to hydrocracking zone 300. Stream 750, then essentially becomes stream 735. This single stage once-through scheme, which will lead to superior product properties, while maintaining the target overall conversion on a fresh feed basis.

In another alternate embodiment of FIG. 1 the hydrocracking reaction zone 300 can include a catalyst including any suitable noble Group VIII metal, such as platinum or palladium provided on a support, such as a silica-alumina or an alumina, along with a acid cracking component of silica alumina or zeolite.

The feedstock for present processes and embodiments is generally a heavy hydrocarbon feed, which can include heavy vacuum gas oil (as a vacuum distillation unit product), heavy gas oil (as a crude distillation unit product), thermally cracked gas oil (as a visbreaking unit, thermal cracking or coking unit product), de-asphalted oil (as a product from solvent de-asphalting unit), cycle oil (as a fluid catalytic cracking unit product), or tar sands derived from gasoil. The feedstock can have boiling point in the range of from 170° C. to 700° C. (338° F. to 1292° F.).

In general, the hydrotreating reaction zone can include a hydrotreating reactor which can have single or multiple catalyst beds and can receive quench hydrogen stream between the beds. Although only one hydrogen quench inlet is shown, it should be understood that the hydrogen stream can be provided anywhere along the hydrotreating reactor and multiple hydrogen streams may be provided depending upon the number of beds. The hydrotreating reactor beds typically contain a catalyst having at least one Group VIII metal, and at least one Group VIB metal. The Group VIII metal is selected from a group consisting of iron, cobalt, and nickel. The Group VIB metal is selected from a group consisting of molybdenum and tungsten. The Group VIII metal can be present in the amount of about 2-20% by weight, and the Group VIB metal can be present in the amount of about 1-25% by weight. Generally, these metals are included on a support material, such as silica or alumina. The operating conditions for hydrotreating reaction zone includes a reaction temperature in the range of from 200° C. to 500° C. (392° F. to 932° F.), and a reaction pressure in the range of from 100 barg to 207 barg (1450 psig to 3002 psig).

The operating conditions for the hot high-pressure separation zone includes a temperature in the range of from 200° C. to 500° C. (392° F. to 932° F.), a pressure in the range of from 100 barg to 207 barg (1450 psig to 3002 psig). The operating conditions for the cold high-pressure separation zone includes a temperature in the range of from 60° C. to 250° C. (140° F. to 482° F.), a pressure in the range of from 100 barg to 207 barg (1450 psig to 3002 psig).

In general, the hydrocracking reaction zone can include a hydrocracking reactor which can have single or multiple catalyst beds and can receive quench hydrogen stream between the beds. Although only one hydrogen quench inlet is shown, it should be understood that the hydrogen stream can be provided anywhere along the hydrocracking reactor and multiple hydrogen streams may be provided depending upon the number of beds. The hydrocracking reactor beds typically contain a catalyst having at least one Group VIII metal, and at least one Group VIB metal. The Group VIII metal is selected from a group consisting of iron, cobalt, and nickel. The Group VIB metal is selected from a group consisting of molybdenum and tungsten. The Group VIII metal can be present in the amount of about 2-20% by weight, and the Group VIB metal can be present in the amount of about 1-25% by weight. Generally, these metals are included on a support material, such as silica or alumina along with acidic component such as an amorphous silica alumina or a zeolite. In another embodiment, the hydrocracking reaction zone can include a catalyst having any suitable noble Group VIII metal, such as platinum or palladium, provided on a support, such as silica-alumina or alumina along with an acid cracking component of a silica alumina or a zeolite. The operating conditions for hydrocracking reaction zone includes a reaction temperature in the range of from 200° C. to 500° C. (392° F. to 932° F.), and a reaction pressure in the range of from 100 barg to 207 barg (1450 psig to 3002 psig).

The operating conditions for the hot high pressure separator drum includes a temperature in the range of from 200° C. to 500° C. (392° F. to 932° F.), and a pressure in the range of from 100 barg to 207 barg (1450 psig to 3002 psig). The operating conditions for the cold high-pressure separator drum includes a temperature in the range of from 40° C. to 80° C. (104° F. to 176° F.), and a pressure in the range of from 100 barg to 207 barg (1450 psig to 3002 psig). The operating conditions for the hot low-pressure flash drum includes a temperature in the range of from 200° C. to 500° C. (392° F. to 932° F.), and a pressure in the range of from 30 barg to 50 barg (435 psig to 725 psig). The operating conditions for the cold low-pressure flash drum includes a temperature in the range of from 40° C. to 80° C. (104° F. to 176° F.), and a pressure in the range of from 30 barg to 50 barg (435 psig to 725 psig). Heat exchangers required to cool the hot streams before entering subsequent separators and flash drums are not shown and their requirement should be understood by one skilled in the art. Typically, the separators and flash drums separate gases from condensed liquids or from liquids through pressure let down.

The operating conditions for the fractionation zone includes a temperature in the range of from 40° C. to 400° C. (104° F. to 752° F.), and a pressure in the range of from 0.05 bar to 30 bar (0.73 psig to 435 psig).

Heat transfer items of equipment, fluid transport equipment and mass transfer equipment are not always shown and their requirement should be understood by one skilled in the art.

Distinct advantages are offered by the integrated hydrocracking apparatus and processes described herein when compared to conventional hydrocracking configurations. The integrated process allows the processing of heavy hydrocarbon feed having high nitrogen and high sulfur contents in a single-stage configuration which allows the reduction of recycle gas in the amount of 3500 to 5500 standard cubic feet per barrel (scf/bbl) or 30% to 40% volumetric reduction. The integrated process also allows the use of amorphous cracking catalyst at reasonable liquid hourly space velocity (LHSV) to maximize the distillate yields (increasing by about 5% distillate selectivity). In addition, the integrated process reduces the hydrocracking catalyst volume by increasing activity by 10° C. to 60° C. (50° F. to 140° F.). The integrated process also has the ability to make high quality distillates and unconverted oil while operating at low conversion rates. Moreover, the integrated process allows the use of noble metal catalyst in the hydrocracking reaction zone when processing heavy feed, thus increasing the overall activity and hydrogenation capability to produce superior distillate products. Furthermore, the integrated process allows a reduction in the system pressure because of higher hydrogen partial pressure at the hydrocracking reaction zone due to the availability of high purity hydrogen gas stream. The problems associated with conventional hydrocracking systems and processes are alleviated by the system and process described herein.

The method and system herein have been described above and in the attached drawings; however, modifications will be apparent to those of ordinary skill in the art and the scope of protection for the invention is to be defined by the claims that follow.

What is claimed is:

1. An integrated hydrotreating and single-stage hydrocracking process comprising:

a. hydrotreating a feedstock with a hydrotreating catalyst in the presence of hydrogen to produce a hydrotreated effluent containing a reduced amount of sulfur-containing and/or nitrogen-containing hydrocarbon compounds as compared to the feedstock;

b. separating the hydrotreated effluent in a high-pressure separation zone to produce a vapor stream and a hydrocarbon liquid stream;

c. purifying at least a portion of the vapor stream in an absorption zone in the presence of at least a portion of relatively heavy components of the vapor stream from step (b) to produce a high purity hydrogen gas stream and a fuel gas stream;

d. hydrocracking at least a portion of the hydrocarbon liquid stream from step (b) with a hydrocracking catalyst in the presence of hydrogen gas in a single-stage reactor configuration to produce a hydrocracked effluent, wherein the hydrogen gas includes at least a portion of the high purity hydrogen gas stream from step (c); and e. separating and fractionating the hydrocracked effluent.

2. The process as in claim 1, where step (b) comprises separating the hydrotreated effluent in a hot high-pressure separation zone to produce a gas stream and a hydrotreated liquid stream, and separating the gas stream in a cold high-pressure separation zone to produce a vapor stream, a hydrocarbon liquid stream and a sour water stream, wherein the relatively heavier components of the vapor stream used in step (c) are derived from the further condensation of the heavier fractions in the vapor stream generated from the cold separator and additional make up provided by the portion of the hydrocarbon liquid stream from the cold high-pressure separation zone.

3. The process as in claim 2, wherein step (d) comprises hydrocracking the hydrotreated liquid stream from the hot high-pressure separation zone and at least a portion of the hydrocarbon liquid stream from the cold high-pressure separation zone.

4. The process as in claim 3, wherein step (e) comprises separating the hydrocracked effluent into a gas stream and a hydrocracked liquid stream;

flashing the gas stream and the hydrocracked liquid stream to produce a flashing overhead stream, a flashing liquid stream and a flashing bottom stream;

fractionating the flashing liquid stream to produce a fractionating overhead stream, a first side-stream, a second side-stream and a fractionating bottom stream;

recycling at least a portion of the fractionating bottom stream to step (d); and recovering the fractionating overhead stream, the first side-stream, the second side-stream, and at least a portion of the fractionating bottom stream as products.

5. The process as in claim 2, wherein step (d) comprises hydrocracking at least a portion of the hydrotreated liquid stream from the hot high-pressure separation zone and at least a portion of the hydrocarbon liquid stream from the cold high-pressure separation zone.

6. The process as in claim 5, wherein step (e) comprises separating the hydrocracked effluent and at least a portion of the hydrotreated liquid stream from step (b) into a gas stream and a hydrocracked liquid stream;

flashing the gas stream and the hydrocracked liquid stream to produce a flashing overhead stream, a flashing liquid stream and a flashing bottom stream;

fractionating the flashing liquid stream to produce a fractionating overhead stream, a first side-stream, a second side-stream and a fractionating bottom stream; and recovering the fractionating overhead stream, the first side-stream, the second side-stream, and the fractionating bottom stream as products.

7. The process as in claim 4, further comprising compressing the flashing overhead stream in a recycle hydrogen compressor to produce compressed recycle hydrogen, and recycling the compressed recycle hydrogen to step (a).

8. The process as in claim 4, further comprising compressing the flashing overhead stream in a recycle hydrogen compressor to produce compressed recycle hydrogen, and recycling the compressed recycle hydrogen to step (d) so that hydrocracking in step (d) occurs in the presence of both the compressed recycle hydrogen and the high purity hydrogen gas stream from step (c).

9. The process as in claim 8, further comprising providing make-up hydrogen for hydrocracking in step (d).

10. The process as in claim 6, further comprising compressing the flashing overhead stream in a recycle hydrogen compressor to produce compressed recycle hydrogen, and recycling the compressed recycle hydrogen to step (a).

11. The process as in claim 6, further comprising compressing the flashing overhead stream in a recycle hydrogen compressor to produce compressed recycle hydrogen, and recycling the compressed recycle hydrogen to step (d) so that hydrocracking in step (d) occurs in the presence of both the compressed recycle hydrogen and the high purity hydrogen gas stream from step (c).

12. The process as in claim 11, further comprising providing make-up hydrogen for hydrocracking in step (d).

13. The process as in claim 1, wherein a portion of the hydrocarbon liquid stream from step (b) is passed to step (e) without hydrocracking.

* * * * *